US007725969B1

(12) United States Patent
Osteyee

(10) Patent No.: US 7,725,969 B1
(45) Date of Patent: Jun. 1, 2010

(54) CLIMBING AND RAPPELLING ACCESSORY AND METHOD

(76) Inventor: Ian Andrew Osteyee, 36 Owls Head La., Keene, NY (US) 12942

( * ) Notice: Subject to any disclaimer, the term of this patent is extended or adjusted under 35 U.S.C. 154(b) by 69 days.

(21) Appl. No.: 11/821,664

(22) Filed: Jun. 25, 2007

Related U.S. Application Data

(60) Provisional application No. 60/805,920, filed on Jun. 27, 2006.

(51) Int. Cl.
*B26B 11/00* (2006.01)

(52) U.S. Cl. ..... 7/118; 7/161; 294/26

(58) Field of Classification Search ..... 7/118, 7/161; 81/177.2, 177.6; 294/26
See application file for complete search history.

(56) References Cited

U.S. PATENT DOCUMENTS 286,209 A * 10/1883 Lincoln ..... 7/167
338,612 A * 3/1886 Pusey ..... 7/118
472,104 A * 4/1892 Von Bultzingslowen ..... 30/163
584,223 A * 6/1897 Hammer ..... 105/354
895,126 A * 8/1908 Thomson ..... 294/26
1,076,010 A * 10/1913 Cameron ..... 24/40
1,318,515 A * 10/1919 Voos ..... 7/118
1,561,262 A * 11/1925 Martin ..... 7/118
2,112,765 A * 3/1938 Darling ..... 294/26
2,372,743 A * 4/1945 Schofield ..... 294/26
3,235,296 A * 2/1966 Day ..... 403/112
3,531,148 A * 9/1970 Rohde ..... 294/26
3,669,133 A * 6/1972 Hyman ..... 135/74
4,034,545 A * 7/1977 Walker ..... 57/280
4,461,080 A * 7/1984 Olson ..... 30/144
4,528,751 A * 7/1985 Olson ..... 30/144
4,805,303 A * 2/1989 Gibbs ..... 30/161
5,152,598 A * 10/1992 Schaffer ..... 362/577
5,283,920 A * 2/1994 Plummer ..... 7/106
5,642,648 A * 7/1997 Wendt et al. ..... 81/15.9
5,937,680 A * 8/1999 Parsons ..... 70/456 R
6,082,232 A * 7/2000 Anderson et al. ..... 81/440
6,293,601 B1 * 9/2001 Johnson ..... 294/26
6,378,168 B1 * 4/2002 Brady et al. ..... 16/110.1
6,499,778 B2 * 12/2002 Boulay ..... 294/26
6,698,049 B2 * 3/2004 McLoudrey ..... 7/158
6,705,654 B2 * 3/2004 Slauf ..... 294/24
6,860,178 B2 * 3/2005 Wang ..... 81/177.2
7,089,619 B2 * 8/2006 Smith ..... 7/128
7,409,766 B2 * 8/2008 Steigerwalt ..... 30/161

OTHER PUBLICATIONS

Will Gadd, Roger Chayer, "Ice & mixed climbing: modern technique", Oct. 1, 2003, Mountaineers Books, p. 124.*
Cox and Fulsaas (Eds.), The Freedom of the Hills, 7th Ed. (Mountaineer Books, Washington, 2003).
Cox and Fulsaas, supra, Part 4.
Cox and Fulsaas, supra, pp. 390-399 and 419-420.

* cited by examiner

*Primary Examiner*—David B Thomas
(74) *Attorney, Agent, or Firm*—Max Stul Oppenheimer

(57) ABSTRACT

A novel tool and process, primarily useful for assisting ice climbers in creating a "V-thread" anchor.

9 Claims, 5 Drawing Sheets

CLIMBING AND RAPPELLING ACCESSORY AND METHOD

This application is entitled to, and claims the benefit of, priority from U.S. Provisional Application Ser. No. 60/805,920, filed Jun. 27, 2006.

FIELD AND BACKGROUND OF THE INVENTION

1. Field of the Invention

This invention relates to tools and processes useful in the field of climbing, and more particularly to a pocket tool and process useful for creating a "V-thread" anchor in ice.

2. Background Information

Ice climbers are faced with the need to create a secure anchor at various points of their climb or descent. One method of creating such anchors is to create a so-called "v-thread" anchor by creating two holes in the ice, angled toward each other so as to intersect at a point sufficiently deep in the ice to remain secure in use, passing one end of a cord in one hole and out the other, then knotting or otherwise securing that end of the cord, thereby forming a loop suitable for attaching a climbing rope, carabiner or other device.

Because the two holes are straight and intersect at an angle, and the cord is flexible, it is difficult to push the cord in one hole and have it bend and emerge through the second hole.

SUMMARY OF THE INVENTION

The foregoing problems are overcome by the invention disclosed herein.

Among the objects of the invention are to provide a process for creating a v-thread anchor and a tool to facilitate creation of such an anchor.

Among the features of the invention are an extendable/retractable rod having a hook at one end, suitable for engaging the cord after the cord has been inserted in one hole so that the cord may be pulled out of the second hole. This provides the advantage of speeding the creation of anchors. In preferred embodiments, the rod either telescopes, folds or coils, providing the additional advantage that it can be easily carried in a climber's pocket when not in use. In a further preferred embodiment, the rod is integrated with a pocket tool (for example, a pocket knife or a multi-tool device) providing the additional advantage of convenience. In a further preferred embodiment, the hook is covered with a retractable or removable cover, providing the additional advantage of safety.

These and other objects, features and advantages will be apparent from the drawings and discussion which follows. The various features of novelty which characterize the invention are pointed out with particularity in the claims annexed to and forming a part of this disclosure. For a better understanding of the invention, its features, advantages and objects, reference is made to the accompanying drawings and descriptive matter in which a preferred embodiment of the invention is illustrated.

BRIEF DESCRIPTION OF THE DRAWINGS

The foregoing and still other objects of this invention will become apparent, along with various advantages and features of novelty residing in the described embodiments, from study of the following drawings, in which.

DESCRIPTION OF THE PREFERRED EMBODIMENT

Figure 1:
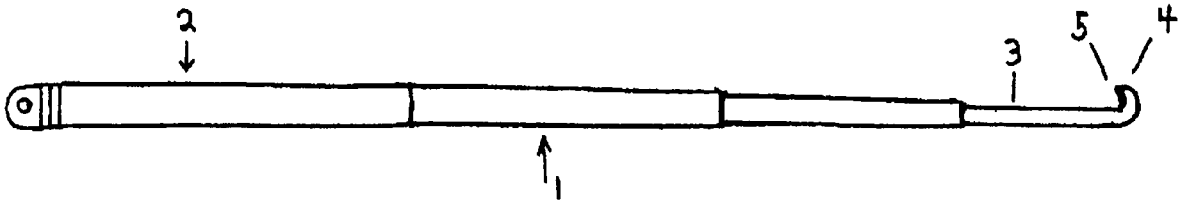
FIG. 1 is a side view of the invention as embodied in a telescoping form, with the rod extended.

Referring to the drawings, the construction and use of the invention will now be described.

The invention is a novel threading tool (referred to herein as a "threader") and process, primarily useful for assisting ice climbers in creating a "V-thread" anchor, illustrated in a standalone form in FIG. 1.

This invention relates to tools and processes useful in the field of climbing, and more particularly to a pocket tool and process useful for creating a "V-thread" anchor. A v-thread anchor is a temporary anchor used by ice climbers (the term "climb" and its variants being used to refer to ascent, descent and essentially horizontal movement unless the context requires otherwise) to increase safety.

Figure 2:
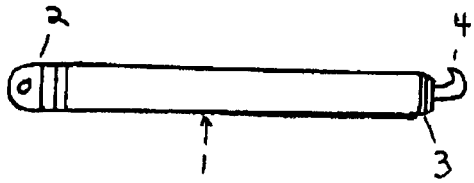
FIG. 2 is a side view of the invention as embodied in a telescoping form, with the rod collapsed.

The formation of a v-thread anchor is facilitated by using the invention, which will be illustrated using the telescoping rod form of the invention, as illustrated in FIGS. 1 and 2. As shown in FIGS. 1 and 2, the invention may be embodied in a rod (1) having a grip segment (2) and at least one remote segment (3), the remote segment terminating in a hook (4) (which may either be formed as part of the rod or attached to the rod) having a hook point (5) and the segments telescoping with respect to each other. Typically, the device would be carried in the closed position (with the segments telescoped one into the other as shown in FIG. 2). It does not matter which segment is considered the grip and which the remote (although ordinarily the hook will be placed on the remote segment for safety reasons).

The choice of materials of construction is within the level of ordinary skill in the art. The rod should be made of a material that will withstand moisture, and will be durable under repeated use. In one category of embodiment (for example, the telescoping example described above and the folding example described below) the rod should resist bending; in an alternative category of embodiment (for example, the winding example described below), the rod should be flexible. A typical extended length of the rod would be about 25 cm.

Figure 3:
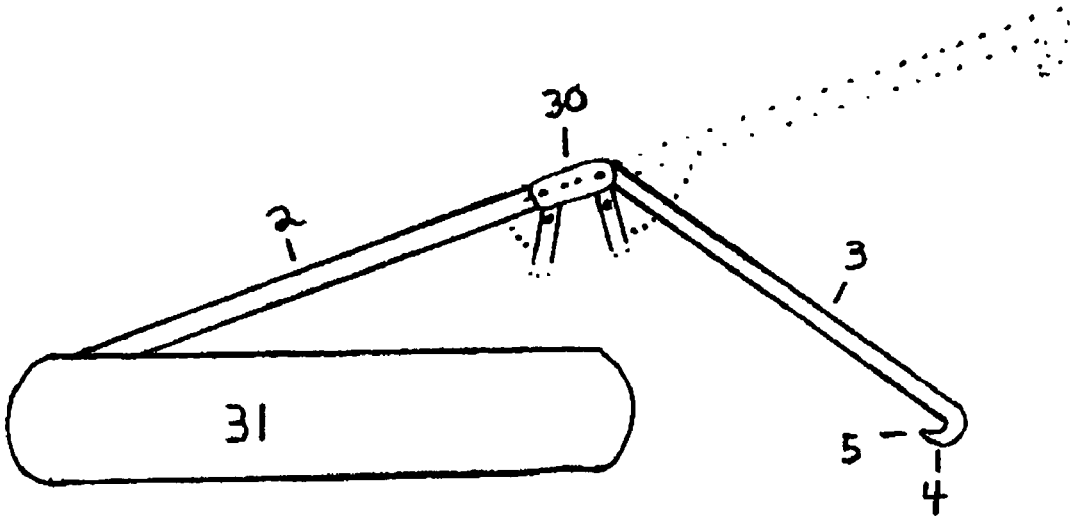
FIG. 3 is a side view of the invention as embodied in a folding rod, with the rod being extended.
Figure 4:
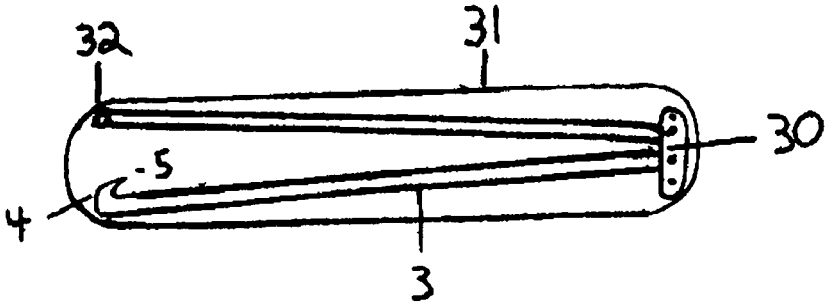
FIG. 4 is a cutaway view of the invention as embodied in a folding rod, with the rod collapsed.

An important feature of the invention is its portability, which is accomplished in the embodiment described above by constructing the rod as telescoping segments. There are other methods of accomplishing the same result (compactness when not in use, but easy to extend when in use). An example is illustrated in FIGS. 3 and 4, showing an embodiment in which the desired characteristics are achieved by providing a hinge (30) between grip segment (2) and remote segment (3) so that the segments may be extended (as shown in FIG. 3 in side view) for use or folded against each other (as shown in FIG. 4 in cutaway view) for transport and storage. The threader is shown incorporated within the frame (31) of a hand tool and pivotably held in place by a pivot (32).

An alternative way of achieving the desired portability employs a flexible rod which may be coiled and held in a coiled position by a coil spring until ready for use as described below.

Although usable as a standalone device as illustrated in FIGS. 1 and 2, climbing is an activity in which space and weight are at a premium and it is therefore desirable to combine the rod with a tool which a climber would otherwise carry. While it could be incorporated in many other types of portable tools, the combination invention will be illustrated with reference to a conventional pocket knife or other pocket tool, as illustrated in FIGS. 3 through 7.

Figure 5:
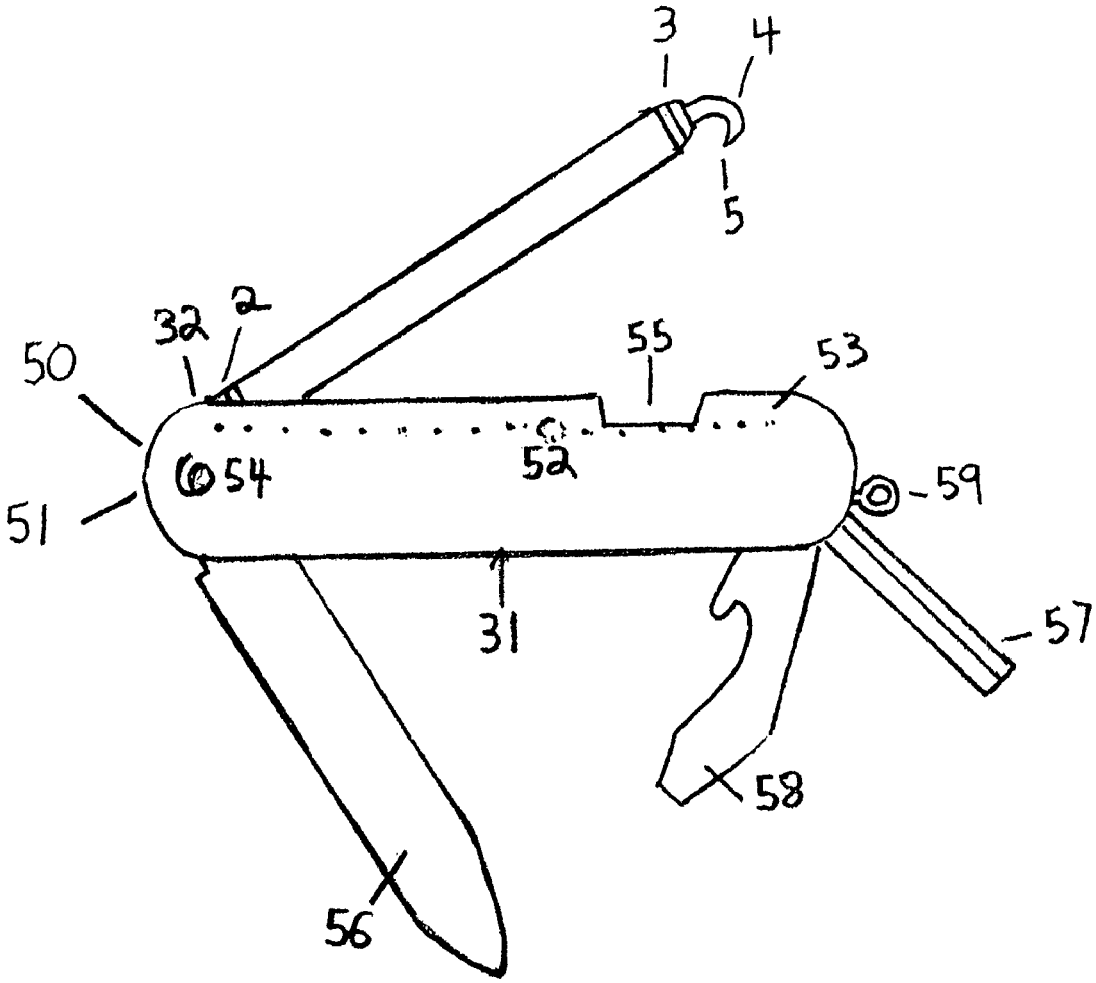
FIG. 5 is a side view of the telescoping form of the invention integrated in a pocket tool (a pocket knife).

As shown in FIG. 5, the rod may be incorporated in a tool (50), such as a pocket knife (illustrated in FIG. 5) or similar pocket tool (illustrated with respect to a folding tool device in FIG. 6) by providing a pivot (32), either near a first end (51) of the tool (50) or at a location near the center (52) of the tool, a suitable recess (53) running longitudinally along a suitable portion of the tool so as to allow the rod (1) to fit within the frame (31) of the tool when not in use and to pivot out from the recess for use. Preferably, a locking mechanism is incorporated to allow locking the rod in either the open (in use) position or closed position. Locating the pivot near the first end (51) has the advantage of providing additional length for the rod and also adding the entire length of the tool to the effective reach of the threader; locating the pivot near the center (52) has the advantage of giving the user a "t-grip", formed between the frame (31) and the rod (1) when extended, which may be a more secure grip. The terms "near", "end" and "center" are used in a comparative sense within the context of achieving these advantages, and not in a precise geometric sense. The rod comprises a grip segment (2) connected to the pivot (32) and a remote segment (3) connected at a first end to the grip segment (2) (using either the telescoping technique described above, as shown in FIGS. 1 and 2 or the hinge technique described above, as shown in FIGS. 3 and 4, or any other method allowing extension for use and retraction for transport or storage) and at a second to (or terminating in) a hook (4). Alternatively, the rod may be made of a flexible material and the grip segment secured within the frame by a coil spring (54) so as to keep the flexible rod in a coiled retracted condition within the frame when not in use; to use the device, the user would pull on the hook segment to uncoil the rod into the extended position. Preferably, a locking/unlocking mechanism would be incorporated with the coil spring to permit locking the flexible rod in the extended position for use, and retract it into the coiled condition within the frame when not in use. Regardless of the extension/retraction system chosen, the point of the hook (5) should face toward the interior of the tool as shown in FIG. 5 so as to minimize the risk of injuring the user or snagging clothing or other material when not in use. Optionally, a cover could be provided to cover the hook when not in use. Optionally, a thumb indent (55) could be provided in the frame (31) so as to facilitate pivoting the rod out from the closed position. FIG. 5 also shows how additional optional tools and features may be incorporated, for example, a knife blade (56), a hex head driver or Phillips head driver (57), a bottle opener/flat blade screwdriver (58) and an attachment ring (59).

Figure 6:
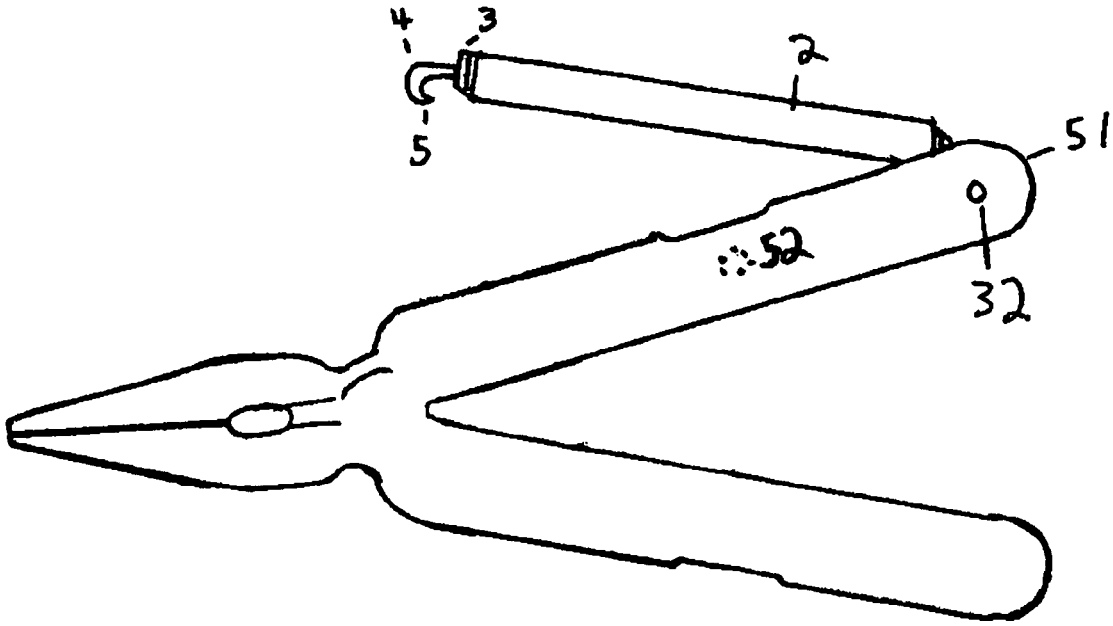
FIG. 6 is a side view of the telescoping form of the invention as embodied in a pocket tool (folding pliers).

FIG. 6 illustrates incorporation of the threader with a folding pliers tool. The principle of incorporation is the same as just described. Although illustrated using the telescoping embodiment, with the rod being extended or closed by telescoping, it would be within the skill of one of ordinary skill in the art to use either the hinged embodiment (unfolding and folding) or the coil embodiment (fastening a flexible threader to a coil spring carried within the frame of the tool).

The use of the threader will now be described with respect to the creation of a typical v-thread anchor. The details of the creation of a v-thread anchor without the aid of a threader are known in the art, and are described, for example, in Mountaineers Book's "The Freedom of the Hills" (edition 7). The following is a brief summary, sufficient to illustrate the use of the novel threader.

Figure 7:
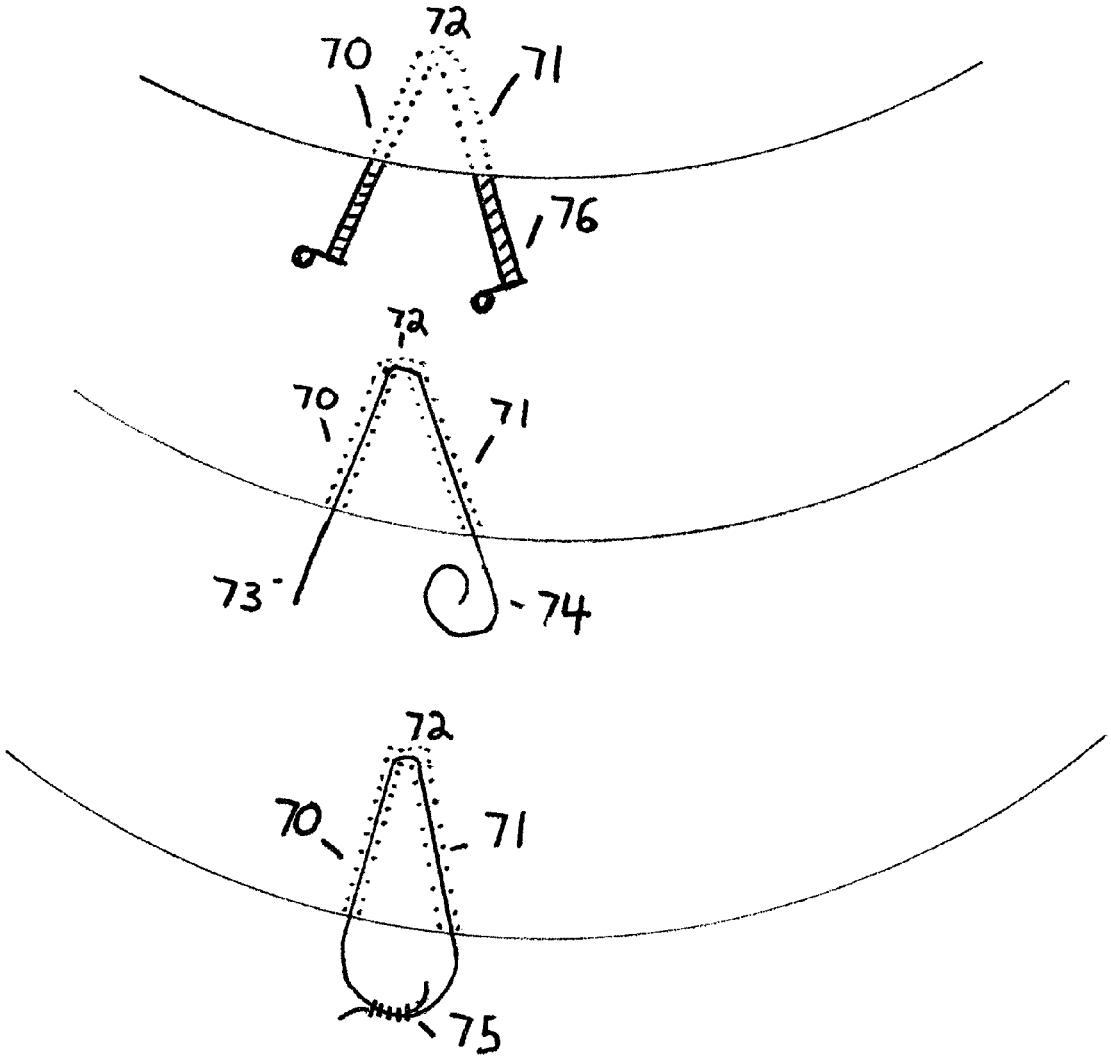
FIG. 7 illustrates the use of the invention to create a v-thread anchor.

As shown in FIG. 7, a v-thread anchor is typically created in ice by the climber by creating an entry hole (70) in the ice, and creating an exit hole (71) in the ice (FIG. 7 illustrates formation of the holes using screws (76)), the holes angled toward each other so as to intersect at an intersection point (72) sufficiently deep in the ice to remain secure in use; passing a first end (73) of an anchor material (74) (which is usually a cord, but in some applications, webbing or other material may be substituted for the cord) in the entry hole (71) to the intersection point (72). The threader is made ready for use by extending the remote segment (3) from the grip segment (2) (as illustrated in FIG. 1) far enough to extend the hook (4) into the exit hole and engage the first end of cord (74) with the hook (4). Once engaged, the rod (1) is withdrawn thereby pulling the cord out through the exit hole. It will be appreciated that the order of the steps may be varied, so long as the cord is hooked by the hook and withdrawn through the exit hole. Once the cord has been drawn through the exit hole, the climber may form a knot (75) or otherwise secure the cord, thereby forming a v-thread anchor to which a climbing rope, carabiner or other device may be attached.

While a specific embodiment of the invention has been shown and described in detail to illustrate the application of the principles of the invention, it will be understood that the invention may be embodied otherwise without departing from such principles and that various modifications, alternate constructions, and equivalents will occur to those skilled in the art given the benefit of this disclosure. Thus, the invention is not limited to the specific embodiment described herein, but is defined by the appended claims.

What is claimed is:

1. A device for facilitating construction of a v-thread anchor, comprising a threader comprising an extendable element terminating in a hook suitable for engaging a cord, wherein said extendable element comprises a flexible element having a first end and a second end, said first end terminating in a hook suitable for engaging a cord and said second end attached to a retracting spring, said device further comprising a pocket tool, said pocket tool having a longitudinal dimension extending from a first end of said pocket tool to a second end of said pocket tool, said threader attached to said pocket tool at a pivot point.

2. A device as in claim 1 wherein said pivot point is located near an end of said pocket tool.

3. A device as in claim 2 wherein said pocket tool is a pocket knife.

4. A device as in claim 2 wherein said pocket tool comprises foldable pliers.

5. A device as in claim 2 wherein said pocket tool comprises a pocket knife.

6. A device as in claim 1 wherein said pivot point is located near the midpoint between said first end of said pocket tool and said second end of said pocket tool.

7. A device as in claim 6 wherein said pocket tool is a pocket knife.

8. A device as in claim 6 wherein said pocket tool comprises foldable pliers.

9. A device as in claim 6 wherein said pocket tool comprises a pocket knife.

* * * * *